US005541409A

United States Patent [19]

Enloe

[11] Patent Number: 5,541,409

[45] Date of Patent: Jul. 30, 1996

[54] HIGH RESOLUTION RETARDING POTENTIAL ANALYZER

[75] Inventor: Carl L. Enloe, Colorado Springs, Colo.

[73] Assignee: The United States of America as represented by the Secretary of the Air Force, Washington, D.C.

[21] Appl. No.: 275,697

[22] Filed: Jul. 8, 1994

[51] Int. Cl.[6] ..... H01J 49/40

[52] U.S. Cl. ..... 250/305; 250/281; 250/292

[58] Field of Search ..... 250/305, 281, 250/283, 286, 287, 292, 293

[56] References Cited

U.S. PATENT DOCUMENTS

| | | | |
|---|---|---|---|
| 3,681,600 | 8/1972 | Rigden et al. | 250/305 |
| 4,320,298 | 3/1982 | Buford, Jr. et al. | 250/358 R |
| 4,584,474 | 4/1986 | Franchy et al. | 250/305 |
| 4,961,880 | 10/1990 | Barker | 252/626 |
| 5,032,723 | 6/1991 | Kono | 250/305 |
| 5,041,760 | 8/1991 | Koloc | 315/111.41 |
| 5,076,971 | 12/1991 | Barker | 252/626 |
| 5,107,111 | 4/1992 | Daimon et al. | 250/305 |
| 5,120,958 | 6/1992 | Davis | 250/287 |
| 5,180,914 | 1/1993 | Davis et al. | 250/287 |

*Primary Examiner*—Jack I. Berman
*Assistant Examiner*—Kiet T. Nguyen
*Attorney, Agent, or Firm*—William G. Auton

[57] ABSTRACT

A simple electrostatic retarding potential analyzer configuration is described that gives a true measure of charged particle energy irrespective of the angle of incidence of the particles. The device has an inherently high energy resolution ($\Delta E/E<0.01$). The device eliminates errors in particle energy measurement usually associated with planar gridded RPA's. Electrostatic models and results from an experimental prototype indicate that the device can determine the energies of charged particles with a high degree of accuracy.

1 Claim, 2 Drawing Sheets

HIGH RESOLUTION RETARDING POTENTIAL ANALYZER

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to energy measurement, and more specifically the invention pertains to a type of electrostatic energy analyzer for charged particles (electrons and ions).

The simplest device for analyzing the energies of a group of charged particles is the planar retarding potential analyzer (RPA), consisting of an electrically biased screen placed between two electrically grounded screens. Although simple, such an analyzer suffers from the drawback that it accurately determines the energies of particles only if they are moving along a line perpendicular to the grids. If the particles enter off-axis, errors are introduced into the measurement. In practical terms, to get good energy resolution from a planar RPA, it is necessary to use fine mesh screens, which limits the amount that the size of the analyzer can be reduced. The present invention corrects these deficiencies.

SUMMARY OF THE INVENTION

The present invention is a high-resolution retarding potential analyzer which is used to determine the energies of a group of charged particles.

It consists of an electrostatically grounded front aperture plate in the shape of a cone with the entrance aperture at the apex of the cone, an electrically biased analyzing structure in the shape of a cylinder with a hole in one end through which the front aperture plate protrudes and a transparent screen across the opposite end, and a particle detector. An electrically grounded transparent screen may be placed between the analyzing region and the particle detector. The device determines the energies of incident charged particles by passing or rejecting particles as a function of the bias potential applied to the analyzing region.

It is an object of the present invention to measure the energies of charged particles with a high degree of accuracy.

It is another object of the invention to aid in the analysis of the charged particle environment in the vicinity of a spacecraft and control of plasma processing applications.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

Figure 1:
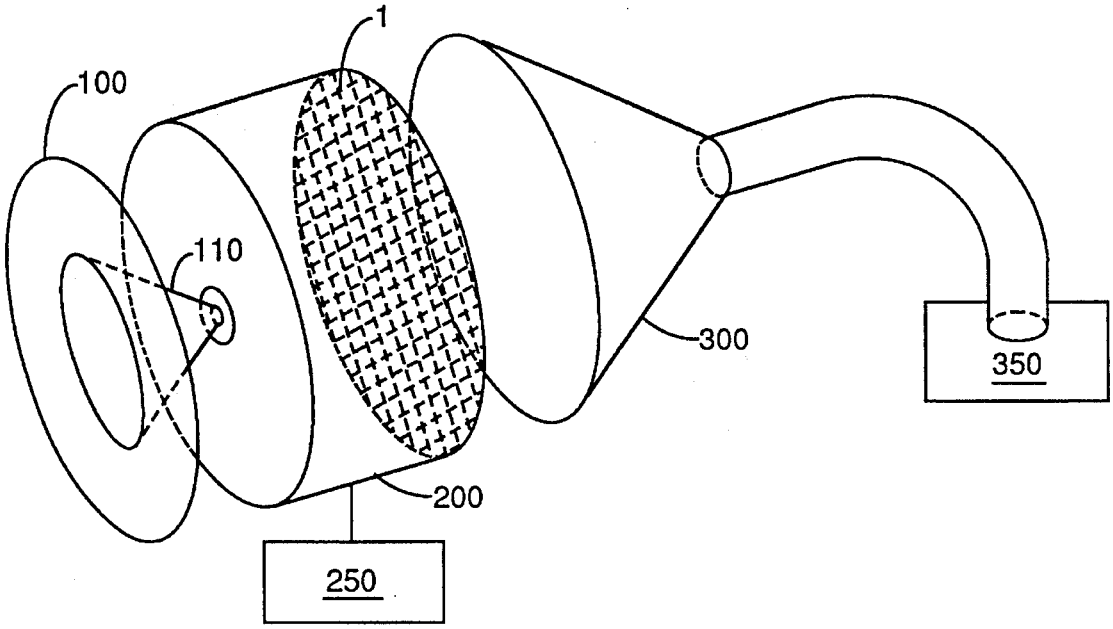
FIG. 1 is an illustration of a high-resolution RPA, consisting of a grounded entrance aperture, a biased retarding structure, and a particle detector.

The present invention is a particular configuration of electrically grounded and biased structures. The configuration is illustrated in FIG. 1. The device consists of an electrically grounded front aperture, aperture plate 100, terminating in the shape of a cone 110, with the actual aperture at the apex of the cone 110, an electrically biased analyzing structure, 200 in the shape of a cylinder, with a hole in one end through which the aperture plate 100 protrudes and a transparent screen covering the other, and a particle detector 300. The particle detector 300 is shown in the figure as a channel electron multiplier, but it may be a microchannel plate or even a simple conducting plate connected to an analog current meter 350 depending on the particle fluxes involved.

The high resolution electrostatic retarding potential analyzer of the present invention is shown in FIG. 1, and is used to determine the energy distribution of a population of charged particles. This device establishes an electrically biased region establishes an equipotential plane between two grounded grids, forming a potential barrier to charged particles. The electrically biased region is produced by the electrical field (shown in FIG. 2) generated within the electrically biased analyzing structure 200, and this electric field is the result of an electrical charge which is applied by the variable voltage generator 250 (shown in FIG. 1). The device operates as an energy filter; for a potential V applied to the retarding grid, only particles with energy $E \geqq qV$ (where q is the charge on the particle) can penetrate the potential barrier.

The present invention described here is illustrated in FIG. 1. The entrance aperture to the device is at the apex of a grounded cone 110. The electrically biased analyzing structure 200 is a cylinder, closed on one end except for a small hole, and closed on the other by the retarding space potential, which is established within the volume of the cylinder when a voltage is applied to it by the voltage source 250. Particles that pass through this structure exit the cylinder and are collected by the particle detector 300. For large particle fluxes this detector may simply be a conducting plate connected to an analog current meter 350, but for most applications this will be an active device such as a channel electron multiplier or a microchannel plate.

Figure 2:
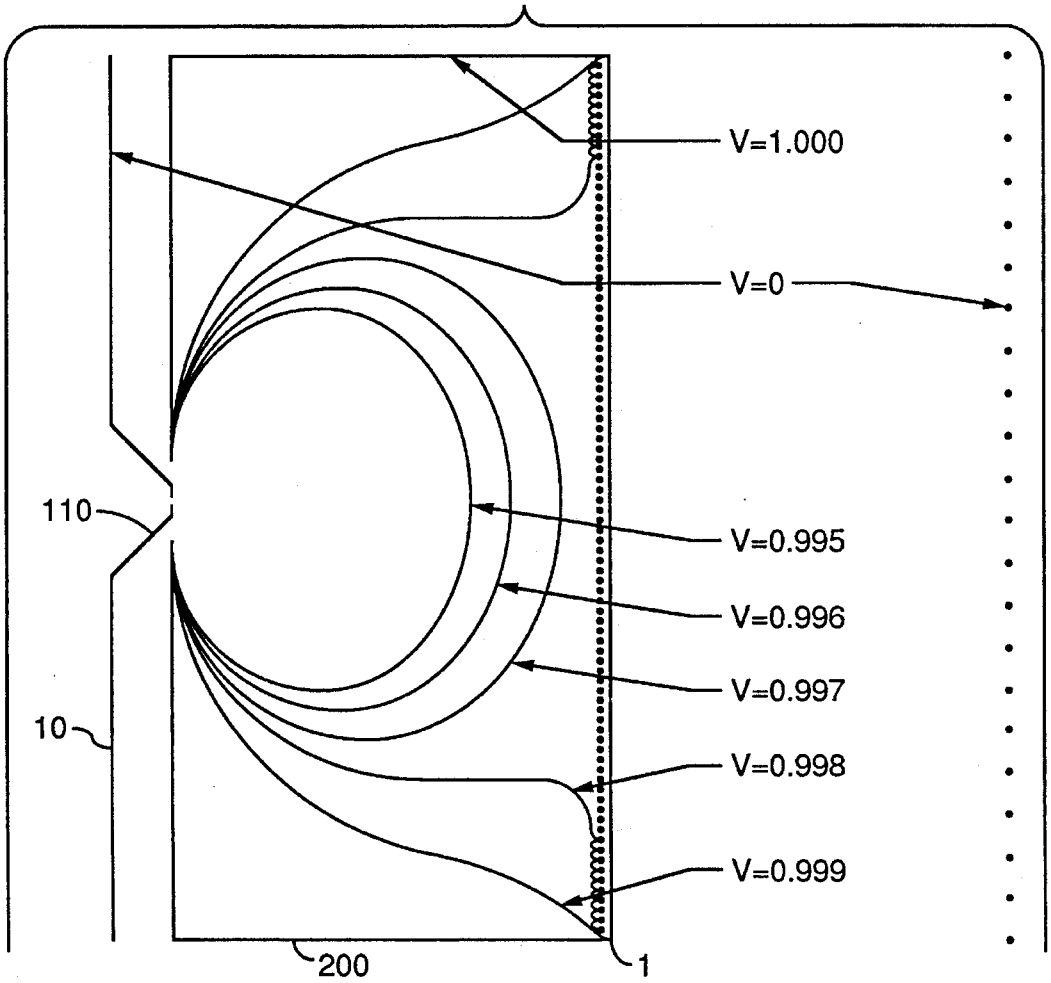
FIG. 2 is a chart of the equipotentials within the retarding structure of FIG. 1.

The space potential established within the cylinder when the cylinder is biased is shown in FIG. 2. The equipotential electric fields are approximately nested spheres. In contrast to a planar device, the equipotentials are approximately normal to the trajectories of the collected particles irrespective of their angle of incidence; hence, the design minimizes errors in the apparent mean energy due to the angle of incidence of the particles. Further, the potential structure is only weakly dependent on the fineness of the screen-the deviation from the applied potential is a fraction of a percent-minimizing errors to variations in the space potential.

Figure 3:
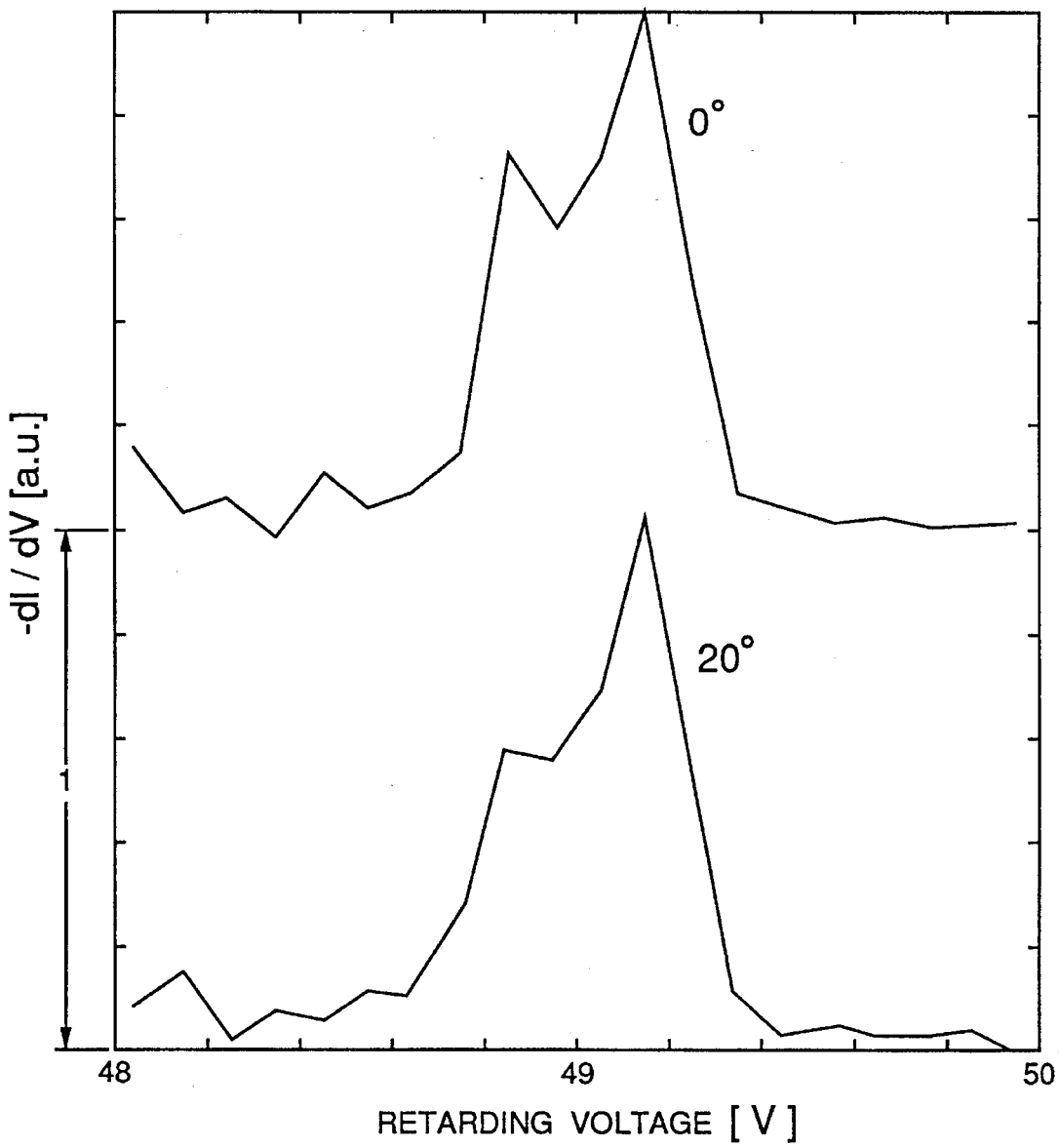
FIG. 3 is a chart of the particle energy distributions determined by a prototype high-resolution RPA for on-and off-axis particle collection.

In one embodiment of the invention, an analyzer was built using a Amptektron integrated channel electron multiplier/bias supply/pulse amplifier package (AmpTek, Inc. model MD-501) as a particle detector 300. The entrance aperture of the prototype was 1 mm in diameter, the cylinder forming the retarding potential structure was 1.90 cm in diameter and 1.27 cm long with a 0.63 cm hole in one end and a 200 lpi stainless steel electroformed mesh covering the other. These measurements are only one example of suitable dimensions. The active area of the channel electron multiplier subtended a range in incident angles from 0° to 20°. The device was exposed to a well-collimated, nearly monoenergic beam of $N_2$ ions at both normal and off-normal incidence. FIG. 3 shows the beam energy distribution determined by the device for a nominal 50 eV ion beam at both 0° and 20° incidence. There is no apparent energy shift between the two (for a planar detector (Δ E/E) shift would be approximately 6 eV). The only variation is a small degree of broadening of the response at the larger angle of incidence. The experimental results give an indication of the energy resolution of the device. A double-peaked energy distribution is evident; the resolution required to resolve such a feature 0.4 eV apart on a 50 eV beam is (Δ E/E)width <0.008.

The inherent energy resolution and accuracy of the present invention make it a superior tool to prior art devices. The present invention is no more difficult to construct, and because the energy resolution is not a strong function of the grid spacing, it is much easier to make physically small.

In operation, the device is aligned so that the flux of particles to be analyzed enter the entrance aperture. The particle flux or current is measured as a varying voltage is applied to the analyzing structure. The equipotential field inside the analyzing region occurs when voltage is applied as illustrated in FIG. 1 and FIG. 2. The potentials are established that no matter what a particle's entrance trajectory, it is always close to parallel to the gradient in the potential. Particles with energy E can pass through the analyzing region only if $E \geqq qV$ where q is the charge on the particles under analysis and V is the voltage applied to the analyzing region.

Because the particles are always moving close to parallel to the gradients in the potential within the analyzing region, the high-resolution retarding potential analyzer of the present invention accurately determines the energies of particles no matter what their angle of incidence. Because the equipotential contours are established within the analyzing region and not only at the grids, it is much less sensitive to the fineness of the screen and can therefore be made much smaller without sacrificing resolution.

Virtually any ratio of dimensions of the components of the device will give similar results. A grounded screen 1 which is electrically connected to the voltage source 250, may be placed between the analyzing region generated in the structure 200 and the particle detector 300 without changing the operation of the device.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. An electrostatic energy analyzer for measuring energies of charged particles and which comprises:

an electrostatically grounded entrance aperture plate which has a shape of a cone which has an entrance aperture for conducting charged particles which are passing its apex:

a means for providing an electrically biased analyzing region containing an electrical bias potential which passes on charged particles of interest and which rejects charged particles which are not of interest, said providing means processing all charged particles received by said electrostatically grounded entrance aperture plate wherein said providing means comprises an electrically charged structure, said charged particles with an energy E to pass through the electrically biased analyzing region only if $E>qV$ where q is the charge on the particle under analysis and V is the voltage applied to the electrically biased analyzing region, wherein said electrically charged structure comprises a cylinder which has a front end through which said charged particles of interest are passed, said cylinder being electrically connected to a voltage source which applies said voltage V to its surface to generate the electrically biased analyzing region;

a means for measuring the energy of charged particles, wherein said measuring means comprises a particle detector selected from the group consisting of: channel electron multipliers, microchannel plates, or a conducting plate structure which is electrically connected to a current meter; and further comprising a transparent screen which is fixed to the output end of said cylinder of said electrically charged structure, said transparent screen being electrically connected to said voltage source.

* * * * *